US006042858A

United States Patent [19]

Kairys

[11] Patent Number: 6,042,858

[45] Date of Patent: Mar. 28, 2000

[54] DISPOSABLE CONTAINER

[76] Inventor: Liutauras Kairys, 4565 S. Christiana, Chicago, Ill. 60632

[21] Appl. No.: 09/130,323

[22] Filed: Aug. 6, 1998

[51] Int. Cl.[7] ..... B65D 77/30

[52] U.S. Cl. ..... 426/119; 426/120; 206/219; 206/221; 206/222

[58] Field of Search ..... 426/86, 115, 120, 426/119; 206/217, 219, 220, 221, 222

[56] References Cited

U.S. PATENT DOCUMENTS

| | | | |
|---|---|---|---|
| 1,483,015 | 2/1924 | Schnackenberg | 206/217 |
| 1,709,168 | 4/1929 | Epperson | 426/86 |
| 1,770,118 | 7/1930 | Williams | 206/217 |
| 1,889,111 | 11/1932 | Serr | 426/86 X |
| 1,933,468 | 10/1933 | Abbot | 206/217 |
| 2,170,311 | 8/1939 | Smith . | |
| 2,885,104 | 5/1959 | Greenspan . | |
| 2,972,406 | 2/1961 | Mayer | 426/86 |
| 3,057,536 | 10/1962 | Warnsdorfer, Jr. et al. | 426/120 X |
| 3,121,636 | 2/1964 | Toms | 426/86 |
| 3,321,097 | 5/1967 | Solowey | 206/221 |
| 3,392,826 | 7/1968 | Powlan . | |
| 3,407,922 | 10/1968 | Palmer | 206/217 |
| 3,534,736 | 10/1970 | Meyers | 206/217 X |
| 3,561,664 | 2/1971 | Palmer | 206/217 X |
| 3,606,068 | 9/1971 | Palmer | 206/217 X |
| 3,669,001 | 6/1972 | Asen | 206/217 X |
| 3,870,220 | 3/1975 | Koury et al. | 426/86 X |
| 4,039,435 | 8/1977 | Narva | 426/115 X |
| 4,061,782 | 12/1977 | Baxter | 426/86 |
| 4,558,804 | 12/1985 | Keck . | |
| 4,625,882 | 12/1986 | Sullivan . | |
| 4,986,433 | 1/1991 | Davis . | |
| 5,241,835 | 9/1993 | Ascone . | |
| 5,328,051 | 7/1994 | Potter et al. . | |
| 5,496,575 | 3/1996 | Newarski . | |
| 5,676,275 | 10/1997 | Khattar . | |

*Primary Examiner*—Milton Cano
*Attorney, Agent, or Firm*—Michael R. McKenna

[57] ABSTRACT

An improved disposable container having a removable divider which separates the interior volume of the container into an edible liquid section and an edible dry section with means for guiding the removal of the divider without crushing the dry edible substance positioned above the divider.

13 Claims, 4 Drawing Sheets

DISPOSABLE CONTAINER

BACKGROUND OF THE INVENTION

This invention relates to an improved disposable container. The improvement comprises means for guiding disposed on the container wherein a pull tab is associated with a segment of a peripheral edge of a divider and extends through the means for guiding. Upon pulling the pull tab, the edge of the divider to which the pull tab is associated disengages from the container and the divider folds upon itself as it is removed.

There are many things we lack in the course of our everyday lives these days. For one, we're forever short of time. We're constantly looking for ways to save time, even at the expense of our health. For another, we're not eating a healthy diet. There never seems to be enough time to prepare something healthy to eat. And finally, we lack convenience foods that are healthy for us. So many times, we'll eat whatever food is conveniently packaged and ready to eat rather than a healthier product that takes longer to prepare. For example, we're all familiar with breakfast cereals that are truly healthy and that we enjoy eating both in the morning and at other times of day. But with our hectic schedules, we don't always have time to eat such a breakfast at home. So we send our children off to school with a few dollars so that they can stuff themselves with junk food. After all, we can't put a carton of milk, a packet of cereal, a bowl, and a spoon into their backpacks!

The instant invention proposes a product that would solve all of the above mentioned problems—a product that would contain breakfast cereal and milk in one disposable, easy to use container. The milk could be in the bottom part of the container, and dry cereal could be in the top part. These two sections would be separated by a sheet of plastic or foil. When the sheet is removed from the interior wall, the cereal falls into the milk and can be eaten right out of the container.

The bottom portion of the container (which may be filled with milk) is covered with a divider—a sheet of plastic film or foil. In a preferred embodiment of this design, the container has a cross-section that is circular, alternatively it could be oval-shaped or rectangular, with a long, narrow length of the foil extending from its edge like a pull tab. This pull tab will be used to remove the foil. After the peripheral edge of the divider is glued on to the interior surface of the container, the pull tab extends above the divider. The pull tab is folded back along the generally horizontal surface of the divider and secured to the opposite wall of the container by means for guiding. Any fastener, clip, or guide bar known in the art may be employed. The fastener may be shaped to follow the contours of the container. The purpose of the means for guiding is to direct the movement of the pull tab in the desired direction. In a first embodiment, the remainder of the pull tab (above the position where it is affected by the fastener) follows the upright side wall of the container to the top. In its packaged state, the end of the tab is folded over the top edge of the container and glued to the outer edge of the container. The container can now be filled with the next ingredient, the cereal. Once the cereal is in place, the container can be covered with a lid.

In a second embodiment of the invention, a generally horizontal circumferential recess is provided in the interior surface of the side wall of the container to hold a ring-like clip with a linear segment. The linear segment is disposed opposite the side of the container along which the pull tab originates. Alternatively, the ring-like clip may be adhesively affixed to the interior surface without the need of a recess, or the interior surface may have a circumferential ledge upon which the ring-like clip may be disposed. Both of the alternatives would require a known+ means of securing the ring-like clip in place such as the adhesive suggested.

In one method of the invention the lid is removed, the end of the pull tab disposed from the edge of the container is lifted, and the pull tab moved upwardly. As the pull tab begins to move in the direction shown by the arrow, it removes the divider. The means for guiding guides the pull tab and the divider first in a generally horizontal direction, as the divider doubles back on itself as it is being removed, the folded back surface glides over the surface remaining to be removed. When it reaches the wall of the container that holds the fastener, the divider moves generally upwardly along the wall. In this way, the divider is removed without disturbing the contents of the container.

In a preferred embodiment of the invention, the lid is adapted to allow the divider to be removed without the need to remove the lid. As a result of this design, the cereal and milk can be mixed together in a single container, ready to eat and ready to go.

The fastener preferably can be glued by a strip of adhesive to the outside wall of the container, just like the end of the tab, so that it would not move.

With both designs, then we get the same result—cereal and milk in a single container, ready to eat and ready to go.

One of the advantages is that the divider can be entirely removed cleanly from the container so that the divider is entirely removed from the interior surface of the circumferential walls. Another advantage is that the removable path is controlled and forces a disengagement of the divider from the interior surface of the circumferential wall. It can be made approximately perpendicular to the interior surface thus minimizing the force required to remove the divider and securing the entire removal of the divider from the interior surface.

A means for guiding may take the form of a mini-fastener attached to the circumferential wall, the side wall and having an elongated member that is transverse to the longitudinal center line of the tab. Preferably, this member will be parallel to the plane of the divider. An alternative that will be easily understood—any elongated horizontal member securely attached to the internal surface of the side wall opposite the side where the tab extends from the divider may serve as a means for guiding as the divider is disengaged from the inner surface of the side wall.

Another advantage is that means for guiding allows for the removal of the divider without disturbing (i.e. pushing against, crushing, or otherwise effecting) the contents of the upper space. Also, uniform forces may be applied to separate the divider from its attachment to the inner surface of the side wall.

Still other advantages will be apparent from the disclosure that follows.

SUMMARY OF THE INVENTION

The invention relates to an improved disposable container having at least one interior side wall and a divider, with an elongated pull tab, that is movable between a first position in which the divider separates the interior volume of the container into a first section and a second section, and a second position in which the divider is at least partially removed allowing association between the first section and the second section, wherein the improvement comprises means for guiding secured to the container, and wherein the pull tab is associated with a segment of a peripheral edge of the divider and extends through the means for guiding. Upon pulling the pull tab, the edge of the divider to which the pull tab is associated disengages from the container and the divider folds upon itself as it moves from the first position to the second position.

BRIEF DESCRIPTION OF THE DRAWINGS

Preferred embodiments of the invention are described hereinafter with reference to the accompanying drawing wherein.

DETAILED DESCRIPTION OF THE INVENTION

Figure 1:
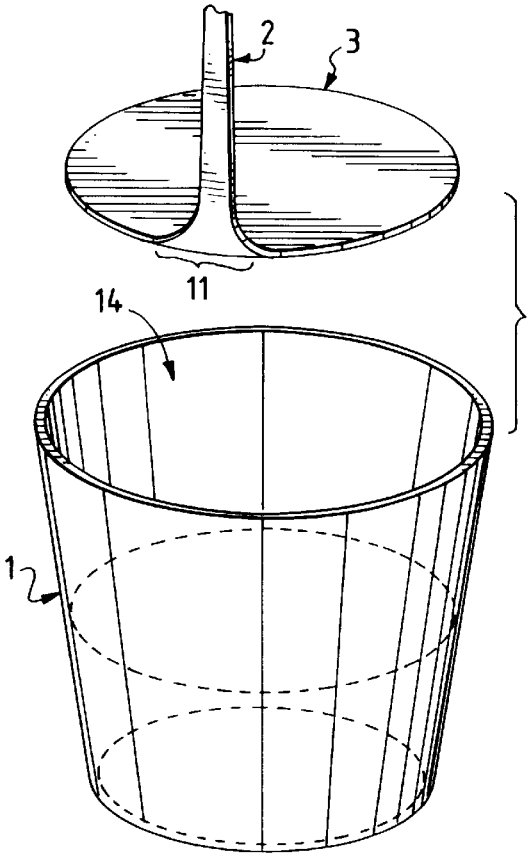
FIG. 1 is an exploded perspective view of a disposable container of the present invention showing a divider with an upstanding pull tab exploded away from the side walls of the container.
Figure 2:
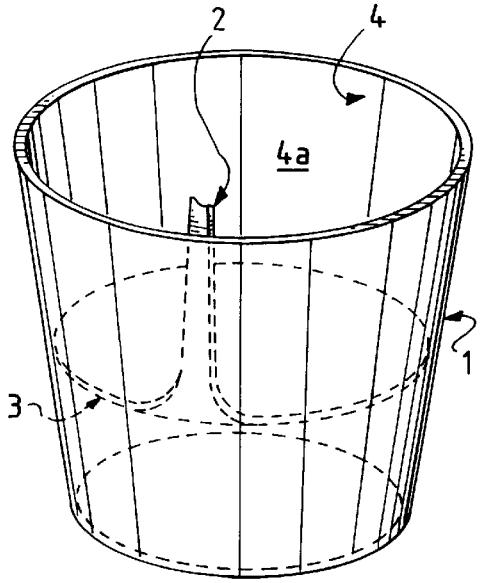
FIG. 2 is a perspective view of the disposable container of the instant invention with the divider disposed in a first position in which the divider separates the interior volume of the container into a first section and a second section.
Figure 3:
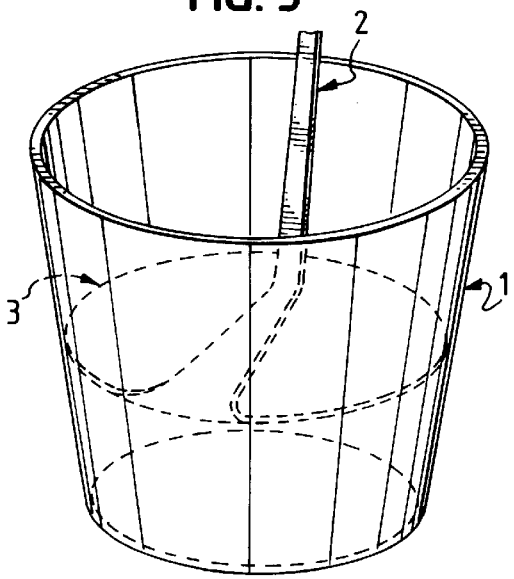
FIG. 3 is a perspective view of the disposable container of the present invention with a portion of the pull tab folded back upon the divider and an adjacent portion of the pull tab disposed uprightly adjacent to a side wall where the pull tab extends from the divider.

The preferred embodiments depicted in the drawing include an improved disposable container 1 having at least one interior side wall 4 and a divider 3, with an elongated pull tab 2, that is movable between a first position in which the divider separates the interior volume 14 of the container into a first section and a second section, and a second position in which the divider is at least partially removed allowing association between the first section and the second section, wherein the improvement comprises means for guiding 5 disposed on the container, and wherein the pull tab 2 is associated with a segment 11 of a peripheral edge 10 of the divider 3 and extends through the means for guiding 5. Upon pulling the pull tab, the edge of the divider to which the pull tab is associated disengages from the container and the divider folds upon itself as it moves from the first position to the second position, as illustrated in FIGS. 5–9.

The discussion that follows, without limiting the scope of the invention, will refer to the invention as depicted in the drawing.

Figure 5:
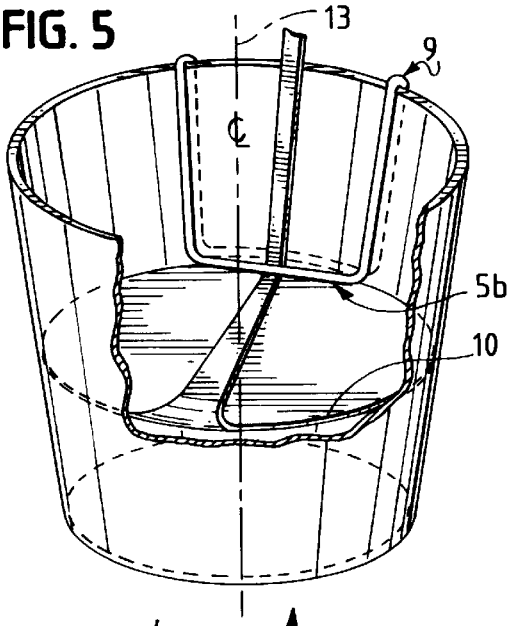
FIG. 5 is a partially cut away perspective view of the disposable container of the present invention showing the clip of FIG. 4 disposed in place on a side wall of the container.

In a preferred embodiment of the present invention of the disposable container 1 shown in FIG. 5, the means for guiding 5 is disposed adjacent the container 1 opposite the segment 11 of the peripheral edge 10 of the divider 3 to which the pull tab 2 is associated.

Figure 12:
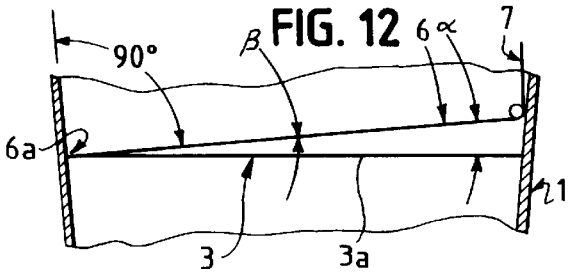
FIG. 12 is a fragmentary side elevation view of the disposable container of the present invention showing the divider in a first plane in the first position and the pull tab disposed along a path, for the removal of the divider, having a generally planer first component that passes through a predetermined angular range, $\alpha$, of the first plane as the divider moves from the first position to the second position, and showing that the means for guiding the movement of the divider from the first position to the second position so that the peripheral edge is disengaged from the interior side wall through forces arising from the movement of the divider that are within a predetermined angular range, $\beta$, from normal to the side wall.
Figure 13:
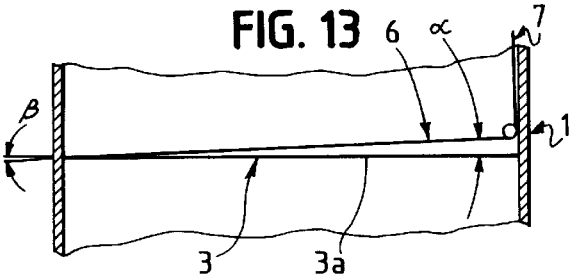
FIG. 13 is a fragmentary side elevation view of the disposable container of the present invention showing the divider in a first plane in the first position and the pull tab disposed along a path, for the removal of the divider, having a generally planer first component that passes through a predetermined angular range, $\alpha$, of the first plane as the divider moves from the first position to the second position, and showing that the means for guiding the movement of the divider from the first position to the second position so that the peripheral edge is disengaged from the interior side wall through forces arising from the movement of the divider that are within a predetermined angular range, $\beta$, from normal to the side wall.
Figure 19:
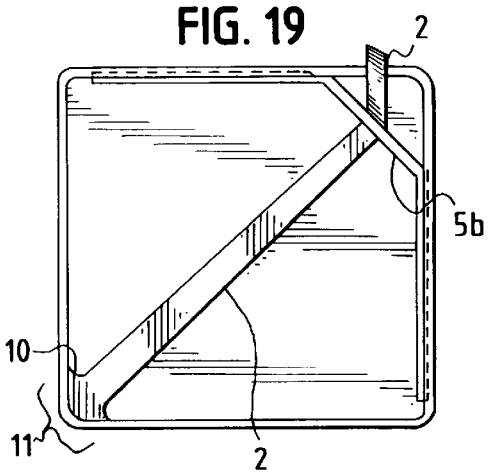
FIG. 19 is a top plan view of the disposable container of the present invention having a rectangular cross section and with a second fastener being a resilient member having at least one elongated element diagonal to one of the corners thereof and with a pair of offshoots shaped to follow the contours of the container with each of said offshoots extending from an end of an at least one elongated element.

In another preferred embodiment of the present invention, the divider 3 may be disposed in a first plane 3*a* in the first position and is moveable along a path while moving from the first position to the second position. The path has a generally planer first component 6 with a line 6*a* within the first component that is further contained in the first plane 3*a* of the divider 3, as shown in FIG. 12.

Referring again to FIG. 12, the divider 3 may further be disposed in a first plane 3*a* in the first position and is moveable along a path while moving from the first position to the second position, the path having a generally planer first component 6 that passes through a predetermined angular range, $\alpha$, of the first plane 3*a* as the divider 3 moves from the first position to the second position. The angular ranges $\alpha$ and $\beta$ are in reality the range of angles between a line normal to one of the plane and another line normal to the other plane where said normal lines have a common point of intersection. For simplicity, these angular ranges, $\alpha$ and $\beta$, are each show in the drawing ostensibly between the two planes.

Figure 14:
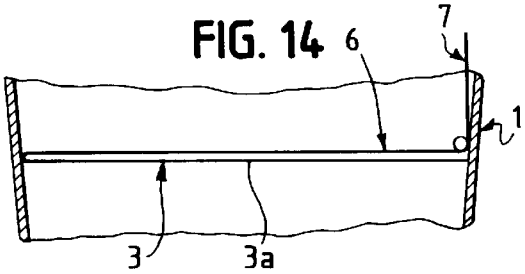
FIG. 14 is a fragmentary side elevation view of the disposable container of the present invention showing the divider in a horizontal first plane in the first position and the pull tab disposed along a path, for the removal of the divider, having a generally horizontal first component.

In a preferred embodiment of the present invention, the first plane is generally horizontal, as shown in FIG. 14.

In another preferred embodiment of the present invention, the divider 3 is disposed in a first plane 3*a* in the first position and is moveable along a path while moving from the first position to the second position, and the path has a generally planer first component 6 that is parallel to the first plane of the divider in the first position. An example of this is shown in FIG. 14 where both the generally planer first component 6 and the divider 3 are horizontal.

Furthermore, the path has a generally upright second component 7 that follows the at least one interior side wall 4 from the means for guiding 5 to the top 1*a* of the container 1.

Figure 6:
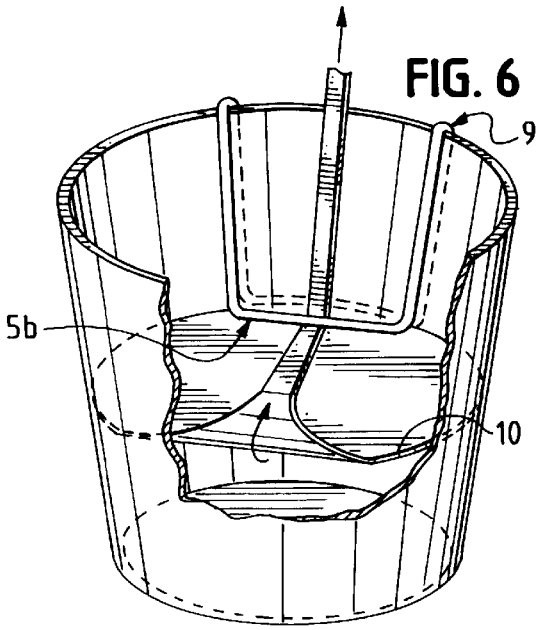
FIG. 6 is a partially cut away perspective view of the disposable container of the present invention with the pull tab having been moved in the direction of the arrow and the divider disposed in the second position with the divider at least partially removed allowing association between the first section and the second section of the container.
Figure 7:
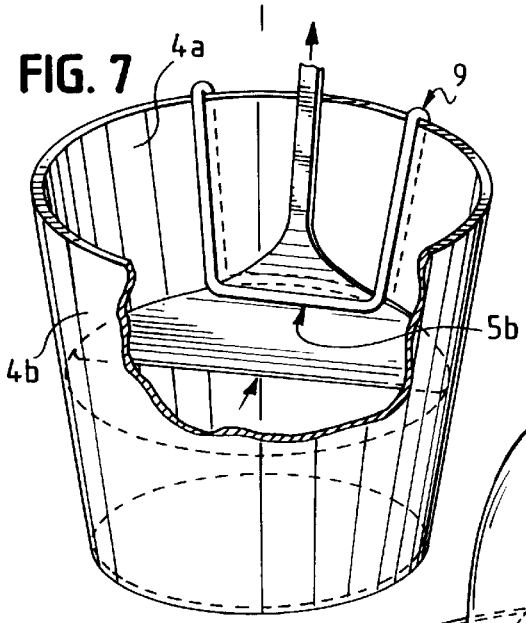
FIG. 7 is a partially cut away perspective view of the disposable container of the present invention showing the pull tab having been moved in the direction of the arrow and the divider disposed in the second position with the divider at least partially removed allowing association between the first section and the second section of the container.
Figure 8:
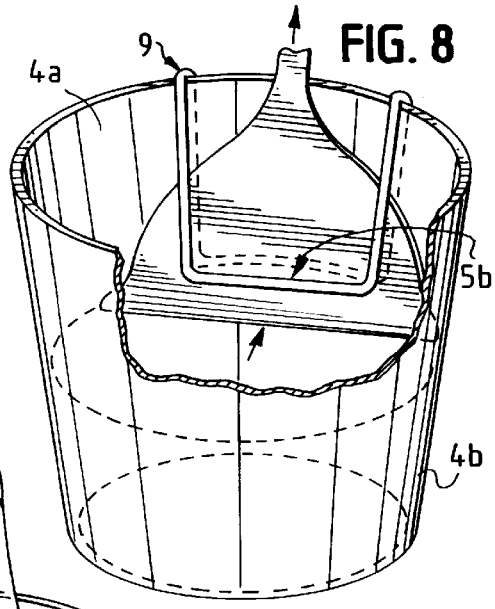
FIG. 8 is a partially cut away perspective view of the disposable container of the present invention showing the divider more fully removed than in the above figures.

The means for guiding 5 may comprise a fastener 5*a* having at least one elongated element 5*b* disposed transverse to the longitudinal axis of the elongated pull tab 2, as shown in FIG. 6.

Again referring to FIG. 6, the means for guiding 5 may comprise a fastener 5*a* having at least one elongated element 5*b* disposed perpendicular to the longitudinal axis of the elongated pull tab 2.

Figure 10:
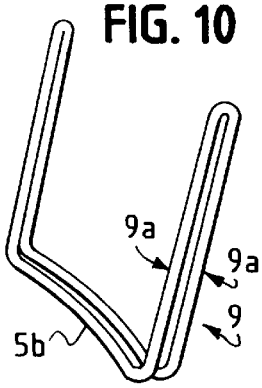
FIG. 10 is a perspective view of a preferred embodiment of the clip of the present invention with the at least one elongated element contoured to follow the shape of the interior surface of the container.

In another preferred embodiment of the present invention, the at least one elongated element 5*b* of fastener, may be disposed adjacent to the at least one interior side wall 4 of the container and contoured to follow the shape of the at least one interior side wall of the container as seen in FIG. 10.

Figure 16:
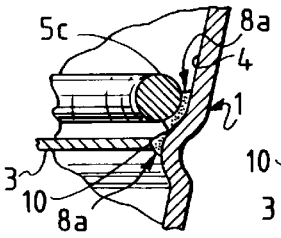
FIG. 16 is an enlarged fragmentary view taken along the line 17—17 of FIG. 15 showing the resilient ring member disposed above a circumferential ridge on an interior surface of the side wall with a layer of adhesive.
Figure 17:
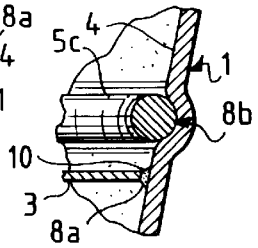
FIG. 17 is an enlarged fragmentary view taken along the line 17—17 of FIG. 15 showing an alternative securing means for the resilient ring member disposed in a circumferential recess in an interior surface of the side wall.
Figure 15:
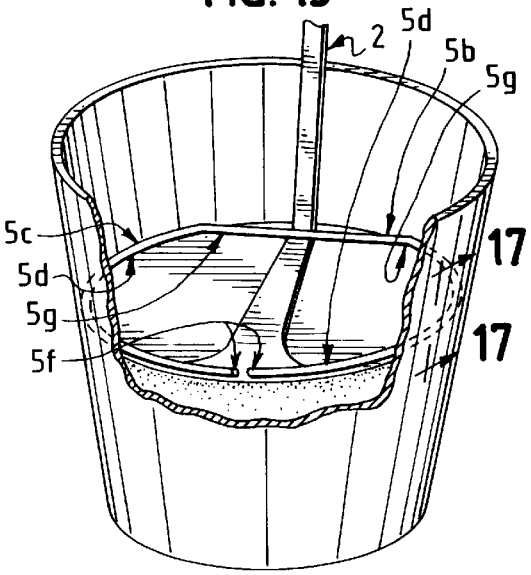
FIG. 15 is a partially cut away perspective view of the disposable container of the present invention with a second preferred embodiment of the fastener having a resilient ring member having a pair of circular arc shaped arms with each of said arms extending from an end of an at least one elongated element.
Figure 11:
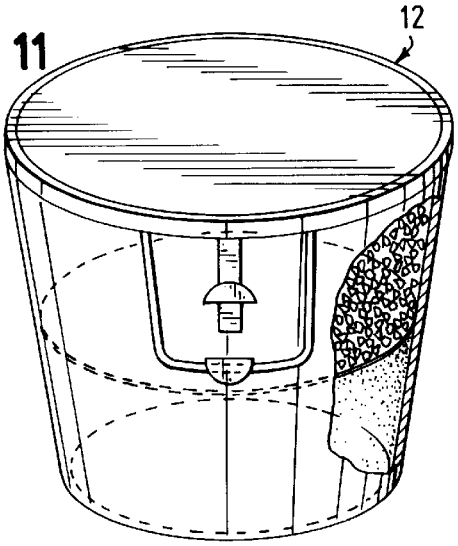
FIG. 11 is a perspective view of the disposable container of the present invention with a lid disposed on the container, and with the end of the pull tab and an exterior portion of the clip each secured to outside of the container with an adhesive strip. A cut-away portion of the container side wall reveals a dry edible substance disposed in the first section above the divider and a liquid edible substance disposed in the second section below the first position of divider.
Figure 18:
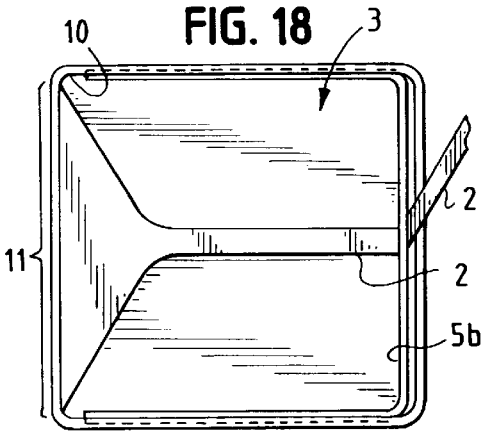
FIG. 18 is a top plan view of the disposable container of the present invention having a rectangular cross section and with a first fastener being a resilient member having a shape following the contours of the container.

The disposable container has means for securing 8 the fastener 5*a* above the divider 3 disposed on the at least one interior side wall 4. The fastener has a resilient ring member 5*c*, as best seen in FIG. 15, having a pair of circular arc shaped arms 5*d*, and each of said arms extends from an end of the at least one elongated element 5*b*. The means for securing 8 comprises at least one of an adhesive 8*a* disposed on the at least one interior side wall 4 and a circumferential recess 8*b* disposed in the at least one interior side wall 4, which are shown in FIGS. 16 and 17, respectively.

The circumferential recess 8*b* may be disposed in the at least one interior side wall 4. Moreover, each of the circular arc shaped arms 5*d* has a free end 5*f* and a connected end 5*g*. Each connected end 5*g* extends from an end of the at least one elongated element 5*b* and each free end 5*f* is disposed at a spaced distance from the other free end. The arms 5*d* of the resilient ring member 5*c* may be pressed together to align the resilient ring member with the recess and the arms of the resilient ring member may be released to secure the arms in the recess 8*b*, as shown in FIG. 15.

Figure 4:
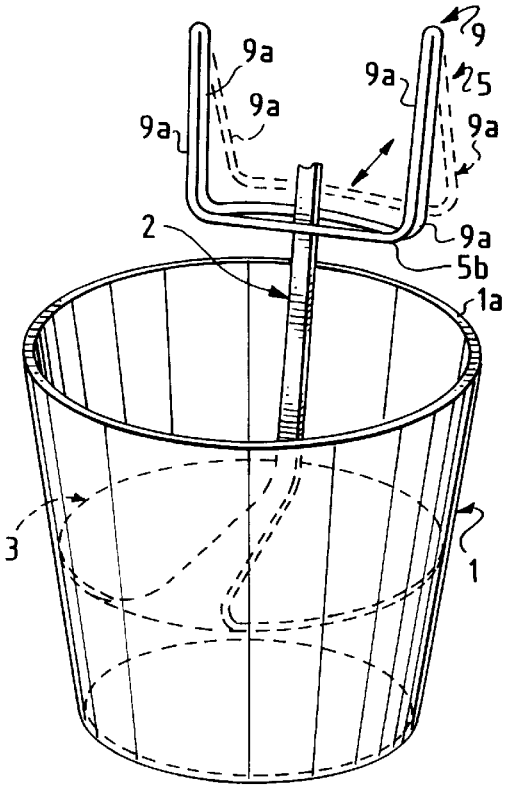
FIG. 4 is an exploded perspective view of the disposable container of FIG. 3 showing an exploded away clip, as a means for guiding, showing the legs of the clip separated in phantom.

The at least one interior side wall 4 has an interior surface 4*a* and an exterior surface 4*b*. Means for securing 8 the fastener 5*a* above the divider 3 are provided and the fastener comprises a clip 9. The clip 9 has opposing legs 9*a* with one of the legs disposed on the interior surface 4*a* and the other leg being disposed on the exterior surface 4*b* of the at least one interior side wall 4. The means for securing 8 the clip 9 comprises at least one of a lid 12 disposed on the top edge 1*a* of the at least one interior side wall, an adhesive 8*a* applied to said at least one side wall, and a clip gripping force resulting from the opposing legs of the clip being separated to fit over the top of the at least one side wall, as shown in FIG. 4.

In a preferred embodiment of the present invention, the clip 9 is removable.

In another preferred embodiment of the present invention, the disposable container has a vertical axis 13, shown in FIG. 5, and the means for guiding 5 comprises a fastener having at least one elongated element 5*b* disposed perpendicular to at least one horizontal line passing through the vertical axis 13.

The first section of the interior volume 14 of the container may be at least partially filled with one of a liquid edible substance 15 and a dry edible substance 16 and the second section is at least partially filled with the other of the liquid edible substance and the dry edible substance. Furthermore, in a preferred embodiment of the invention, the first section of the interior volume of the container is disposed below the divider and is at least partially filled with a liquid edible substance and the second section is at least partially filled with a dry edible substance, and wherein the means for guiding allows removal of the divider from the first position through the second position while maintaining the shape of the dry edible substance 16.

In another preferred embodiment of the present invention, the improved disposable container of the type in which a divider 3, with a pull tab 2 and a peripheral edge 10 that is sealingly attached (with an adhesive 8*a* or equivalent, as shown in FIGS. 16 and 17) to at least one interior side wall 4 of the container 1, is movable between a first position, in which the divider 3 separates the interior volume of the container into a first section and a second section, and a second position in which the divider is at least partially removed allowing association between the first section and the second section, wherein the improvement comprises means for guiding the movement of the divider from the first position to the second position so that the peripheral edge 10 is disengaged from the at least one interior side wall 4 through forces arising from the movement of the divider 3 that are generally normal to the at least one interior side wall 4.

Figure 9:
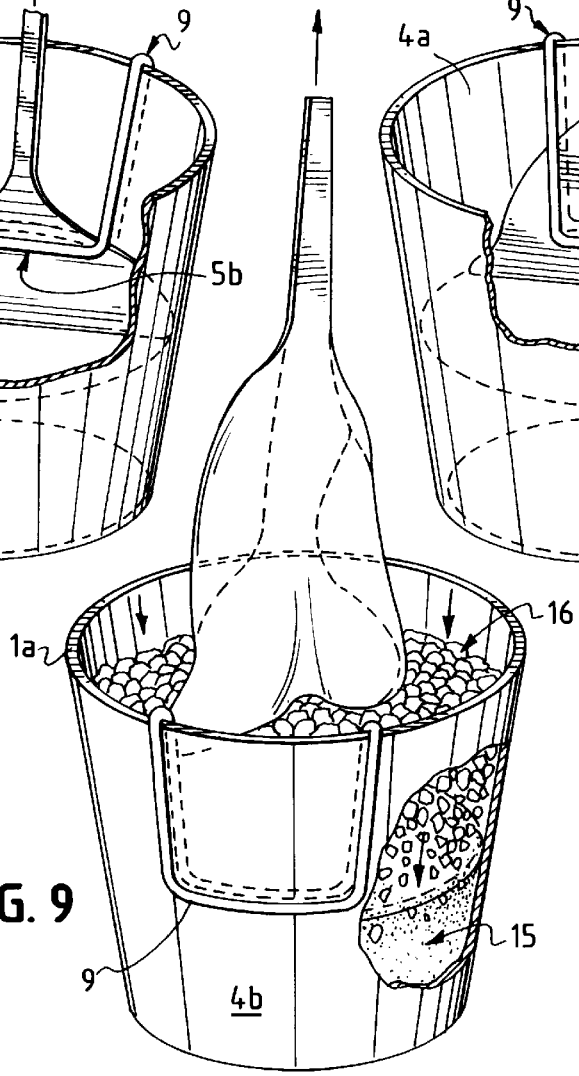
FIG. 9 is an exploded perspective view of the disposable container of the present invention showing the divider almost entirely removed from the container and with a partial cut away view of the interior of the container showing a dry edible substance that was initially disposed in the first section above the divider mixing with a liquid edible substance that was initially disposed in the second section below the first position of divider.

Additionally, the divider may be movable between the first position and a third position in which the divider is fully disengaged from the at least one interior side wall, as shown in FIG. 9, allowing association between the first section and the second section without obstruction from the divider 3.

In a preferred embodiment of the present invention, the improved disposable container of the type in which a divider 3, with a pull tab 2 and a peripheral edge 10 that is sealingly attached to an interior side wall 4 of the container 1, is movable between a first position, in which the divider separates the interior volume 14 of the container into a first section and a second section, and a second position in which the divider 3 is at least partially removed allowing association between the first section and the second section, wherein the improvement comprises means for guiding the movement of the divider 3 from the first position to the second position so that the peripheral edge 10 is disengaged from the interior side wall 4 through forces arising from the movement of the divider 3 that are within a predetermined angular range, β, from normal to the side wall.

Alternatively, the improved disposable container having a divider 3 with an elongated pull tab 2 that is movable between a first position, in which the divider separates the interior volume of the container into a first section and a second section, and a second position in which the divider is at least partially removed allowing association between the first section and the second section, wherein the improvement comprises means for guiding 5 having at least one elongated element 5*b* disposed transverse to the longitudinal axis of the elongated pull tab 2 and disposed on the container 1 opposite the segment 11 of the peripheral edge 10 of the divider 3 to which the pull tab 2 is associated, and wherein the pull tab is associated with a segment of a peripheral edge of the divider and extends through the means for guiding. Upon pulling the pull tab 2, the edge of the divider to which the pull tab is associated disengages from the container and the divider folds upon itself as it moves from the first position to the second position.

Figure 20:
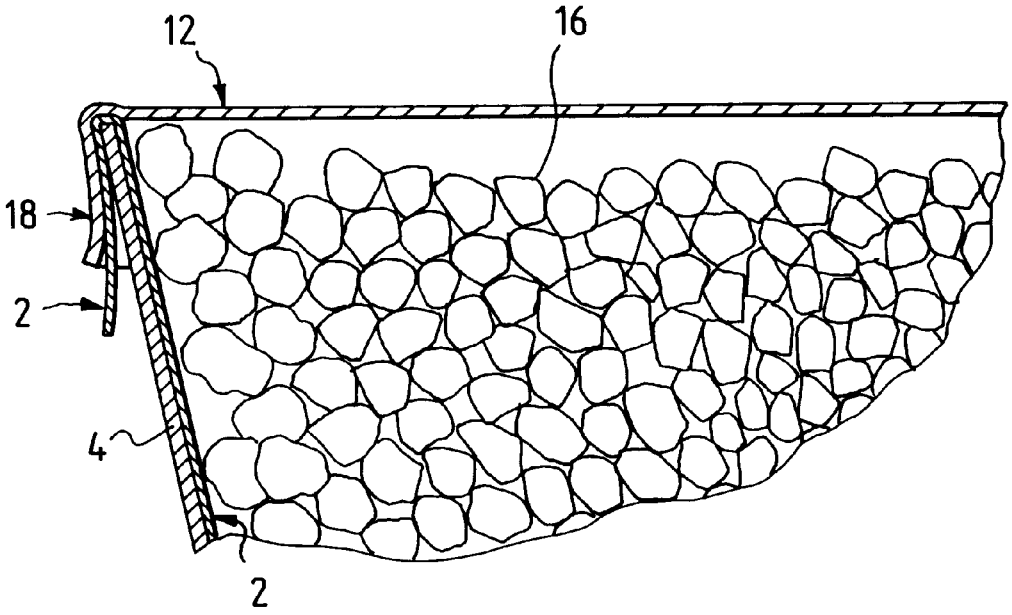
FIG. 20 is a fragmentary cross section view of the disposable container of the present invention of FIG. 11 showing the lid having a peripheral flange with an end of the elongated pull tab extending out from under said lid.
Figure 21:
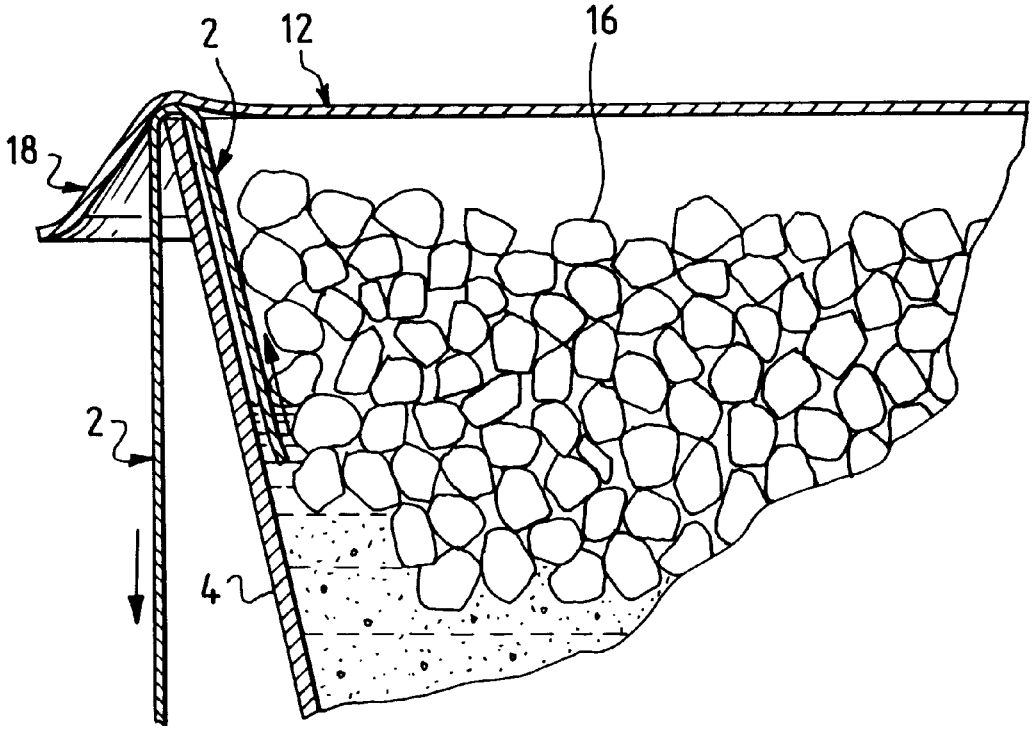
FIG. 21 is a fragmentary cross section view of the disposable container of the present invention of FIG. 11 showing the peripheral flange of the lid flexing outwardly when the elongated pull tab is pulled out from under said lid.

In a preferred embodiment of the invention, the lid 12 is adapted to allow the divider 3 to be removed without the need to remove the lid 12. The lid disposed on a top edge 1*a* of the at least one interior side wall 4. The lid has a peripheral flange 18, and an end of the elongated pull tab 2 extends out from under the lid 12. The peripheral flange is adapted to allow the divider 3 to be removed from the container while maintaining the lid 12 in place. The peripheral flange of the lid flexes outwardly as the elongated pull tab is pulled out from under said lid as shown in FIGS. 20 and 21.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims.

The invention resides not in any one of these features per se, but rather in the particular combination of all of them herein disclosed and claimed and it is distinguished from the prior art in this particular combination of all of its structures for the function specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is a follows:

1. In a disposable container having at least one interior side wall and a divider, with an elongated pull tab, that is movable between a first position in which the divider separates the interior volume of the container into a first section and a second section, and a second position in which the divider is at least partially removed allowing association between the first section and the second section, wherein the improvement comprises:

means for guiding the divider secured to the container, wherein the means for guiding comprises a fastener having at least one elongated element disposed perpendicular to the longitudinal axis of the elongated pull tab, and wherein the pull tab is associated with a segment of a peripheral edge of the divider and extends through the means for guiding, whereby, upon pulling the pull tab, the edge of the divider to which the pull tab is associated disengages from the container and the divider folds upon itself as it moves from the first position to the second position.

2. In a disposable container having at least one interior side wall and a divider, with an elongated pull tab, that is movable between a first position in which the divider separates the interior volume of the container into a first section and a second section, and a second position in which the divider is at least partially removed allowing association between the first section and the second section, wherein the improvement comprises:

means for guiding the divider secured to the container, wherein the means for guiding comprises a fastener having at least one elongated element disposed transverse to the longitudinal axis of the elongated pull tab, and wherein the pull tab is associated with a segment of a peripheral edge of the divider and extends through the means for guiding, whereby, upon pulling the pull tab, the edge of the divider to which the pull tab is associated disengages from the container and the divider folds upon itself as it moves from the first position to the second position.

3. The disposable container of claim 2, wherein the at least one elongated element of fastener is disposed adjacent to an interior surface of the container and contoured to follow the shape of the interior surface of the container.

4. The disposable container of claim 2, wherein the at least one elongated element is disposed adjacent to the at least one interior side wall and contoured to follow the shape of the at least one interior side wall of the container.

5. The disposable container of claim 2, wherein the at least one interior side wall has means for securing the fastener above the divider and wherein the fastener comprises a resilient ring member having a pair of circular arc shaped arms, and each of said arms extends from an end of the at least one elongated element.

6. The disposable container of claim 5, wherein the means for securing comprises at least one of an adhesive disposed on the at least one interior side wall and a circumferential recess disposed in the at least one interior side wall.

7. The disposable container of claim 5, wherein the means for securing comprises a circumferential recess disposed in the at least one interior side wall and wherein each of the circular arc shaped arms has a free end and a connected end, each connected end extends from an end of the at least one elongated element, and each free end is disposed at a spaced distance from the other free end, whereby, the arms of the resilient ring member are pressed together to align the resilient ring member with the recess and the arms of the resilient ring member are released to secure the arms in the recess.

8. The disposable container of claim 2, wherein the container has at least one interior side wall has an interior surface and an exterior surface, with means for securing the fastener above the divider and wherein the fastener comprises a clip, said clip having opposing legs, one of said legs being disposed on the interior surface and the other leg being disposed on the exterior surface of the at least one interior side wall.

9. The disposable container of claim 8, wherein the means for securing the clip comprises at least one of a lid disposed on the top edge of the at least one interior side wall, an adhesive applied to said at least one side wall, and a clip gripping force resulting from the opposing legs of the clip being separated to fit over the top of the at least one side wall.

10. The disposable container of claim 9, wherein the clip is removable.

11. In a disposable container having at least one interior side wall and a divider, with an elongated pull tab, that is movable between a first position in which the divider separates the interior volume of the container into a first section and a second section, and a second position in which the divider is at least partially removed allowing association between the first section and the second section, wherein the improvement comprises:

means for guiding the divider secured to the container, wherein the disposable container has a vertical axis and the means for guiding comprises a fastener having at least one elongated element disposed perpendicular to at least one horizontal line passing through the vertical axis, and wherein the pull tab is associated with a segment of a peripheral edge of the divider and extends through the means for guiding, whereby, upon pulling the pull tab, the edge of the divider to which the pull tab is associated disengages from the container and the divider folds upon itself as it moves from the first position to the second position.

12. In a disposable container having a divider with an elongated pull tab that is movable between a first position, in which the divider separates the interior volume of the container into a first section and a second section, and a second position in which the divider is at least partially removed allowing association between the first section and the second section, wherein the improvement comprises:

means for guiding the divider having at least one elongated element disposed transverse to the longitudinal axis of the elongated pull tab and disposed on the container opposite the segment of the peripheral edge of the divider to which the pull tab is associated, and wherein the pull tab is associated with a segment of a peripheral edge of the divider and extends through the means for guiding, and wherein:

the divider is disposed in a first plane in the first position and is moveable along a path while moving from the first position to the second position, said path having a generally planer first component that passes through a predetermined angular range of the said first plane as the divider moves from the first position to the second position, the path has a generally upright second component that follows the at least one interior side wall from the means for guiding to the top of the container, the at least one interior side wall has means for securing the fastener above the divider and wherein the fastener comprises a resilient ring member having a pair of circular arc shaped arms, and each of said arms extends from an end of the at least one elongated element, and the first section of the interior volume of the container is at least partially filled with one of a liquid edible substance and a dry edible substance and the second section is at least partially filled with the other of the liquid edible substance and the dry edible substance;

whereby, upon pulling the pull tab, the edge of the divider to which the pull tab is associated disengages from the container and the divider folds upon itself as it moves from the first position to the second position.

13. In a disposable container having a divider with an elongated pull tab that is movable between a first position, in which the divider separates the interior volume of the container into a first section and a second section, and a second position in which the divider is at least partially removed allowing association between the first section and the second section, wherein the improvement comprises:

means for guiding the divider having at least one elongated element disposed transverse to the longitudinal axis of the elongated pull tab and disposed on the container opposite the segment of the peripheral edge of the divider to which the pull tab is associated, and wherein the pull tab is associated with a segment of a peripheral edge of the divider and extends through the means for guiding, and wherein:

the divider is disposed in a first plane in the first position and is moveable along a path while moving from the first position to the second position, said path having a generally planer first component that passes through a predetermined angular range of the said first plane as the divider moves from the first position to the second position, the path has a generally upright second component that follows the at least one interior side wall from the means for guiding to the top of the container, the container has at least one interior side wall has an interior surface and an exterior surface, with means for securing the fastener above the divider and wherein the fastener comprises a clip, said clip having opposing legs, one of said legs being disposed on the interior surface and the other leg being disposed on the exterior surface of the at least one interior side wall, the means for securing the clip comprises at least one of a lid disposed on the top edge of the at least one interior side wall, an adhesive applied to said at least one side wall, and a clip gripping force resulting from the opposing legs of the clip being separated to fit over the top of the at least one side wall, and the first section of the interior volume of the container is at least partially filled with one of a liquid edible substance and a dry edible substance and the second section is at least partially filled with the other of the liquid edible substance and the dry edible substance;

whereby, upon pulling the pull tab, the edge of the divider to which the pull tab is associated disengages from the container and the divider folds upon itself as it moves from the first position to the second position.

* * * * *